US005709396A

United States Patent [19]

Zorzi et al.

[11] Patent Number: 5,709,396

[45] Date of Patent: Jan. 20, 1998

[54] ROLLER SKATE WITH IMPROVED COMFORT

[75] Inventors: Claudio Zorzi, Paderno di Ponzano Veneto; Francesco Caeran, Montebelluna, both of Italy

[73] Assignee: Nordica S.p.A., Trevignano, Italy

[21] Appl. No.: 816,198

[22] Filed: Apr. 2, 1997

Related U.S. Application Data

[63] Continuation of Ser. No. 456,457, Jun. 1, 1995, abandoned.

[30] Foreign Application Priority Data

Jun. 9, 1994 [IT] Italy ..... TV94A0065

[51] Int. Cl.[6] ..... A63C 17/06

[52] U.S. Cl. ..... 280/11.28; 280/11.22

[58] Field of Search ..... 280/11.19, 11.2, 280/11.22, 11.23, 11.26, 11.27, 11.28, 87.03, 87.041, 87.042

[56] References Cited

U.S. PATENT DOCUMENTS

| | | | |
|---|---|---|---|
| 324,364 | 8/1885 | Cornelius | 280/11.19 |
| 2,552,987 | 5/1951 | Loertz | 280/11.28 |
| 2,553,450 | 5/1951 | Fuller | 280/11.28 |
| 4,272,090 | 6/1981 | Wheat | 280/11.22 |
| 4,351,538 | 9/1982 | Berta | 280/11.26 |
| 4,915,399 | 4/1990 | Marandel | 280/11.28 |
| 5,312,120 | 5/1994 | Wiegner | 280/11.2 |
| 5,342,071 | 8/1994 | Soo | 380/11.2 |
| 5,582,418 | 12/1996 | Closser | 280/11.22 |

FOREIGN PATENT DOCUMENTS

| | | |
|---|---|---|
| 2 660 205 | 10/1991 | France . |
| 9 314 840 | 8/1993 | WIPO . |

*Primary Examiner*—Kevin Hurley
*Assistant Examiner*—Frank Vanaman
*Attorney, Agent, or Firm*—Guido Modiano; Albert Josif

[57] ABSTRACT

Roller skate with improved comfort including dampers for damping only the forces that are applied to the wheels along axes that are not at right angles to the frame. It is thus possible to improve foot comfort while maintaining optimum transmission of the efforts of the foot to the wheels.

22 Claims, 3 Drawing Sheets

201
205
206
207
210
212
219

ROLLER SKATE WITH IMPROVED COMFORT

This is a continuation of application Ser. No. 08/456,457, filed on Jun. 1, 1995, now abandoned.

BACKGROUND OF THE INVENTION

The present invention relates to a roller skate with improved comfort.

Conventional roller skates have a rigid support for supporting and securing a shoe, and adapted wings or shoulders protruding below said support; two front wheels and two rear wheels are pivoted between said wings or shoulders.

The drawback observed in these conventional skates substantially resides in that any unevenness of the ground is transmitted directly through the wheels to the support and thus to the skater's foot, causing early tiring or possible loss of balance.

U.S. Pat. No. 2,552,987 partially solves that problem with a roller skate having a rigid support for a shoe, two pairs of arms being rotatably associated with said support at one end and a wheel being rotatably associated between each arm.

Each pair of arms can oscillate, at its free end, in contrast with a spring interposed between said end and the lower surface of the shoe rigid support.

Although this solution allows to compensate for any unevenness of the ground, it has the drawback that this compensation or damping occurs also when not desired, for example when the skater is pushing, part of the force transmitted to the wheels is absorbed by the compression of the springs, and therefore there is a dispersion of forces that limits efficiency during the pushing action.

This problem is also felt when the user performs slalom skating, since every sudden change in direction is followed by an additional compression of the springs, which on one hand limits the sensitivity of the athlete and on the other hand can produce unpleasant situations of compression-elongation of the springs during slalom skating that can lead to discordant movements.

Also in a speed competition, the springs would still constitute a drawback, because they would imbalance the athlete with respect to a very specific position that he must assume in order to reach the maximum possible speed; this position usually entails bending the legs and lowering the trunk, and is therefore not very stable for the user.

SUMMARY OF THE INVENTION

The aim of the present invention is therefore to eliminate the technical problems and the drawbacks of the described prior art, by providing a skate that both damps the unevennesses of the ground and provides a rigid connection between the wheels and the shoe.

Within the scope of this aim, an important object is to provide a skate in which these two apparently contrasting features can be selectively chosen by the user.

Another important object is to provide a skate in which these features can be selected quickly and easily by the user.

Another important object is to provide a skate that is structurally simple as well as reliable and safe in use.

This aim, these objects, and others which will become apparent hereinafter are achieved by a roller skate with improved comfort comprising a frame, supporting a plurality of wheels, characterized in that it comprises a damping means connecting each of said wheels to said frame and adapted to damp only forces applied to the wheels in a direction which does not lie in a vertical plane extending essentially perpendiculary to the contact plane of the wheels

BRIEF DESCRIPTION OF THE DRAWINGS

Further characteristics and advantages of the present invention will become apparent from the following detailed description of three particular but not exclusive embodiments thereof, illustrated only by way of non-limitative example in the accompanying drawings, wherein.

DESCRIPTION OF THE PREFERRED EMBODIMENTS

Figures 1, 2, 3:
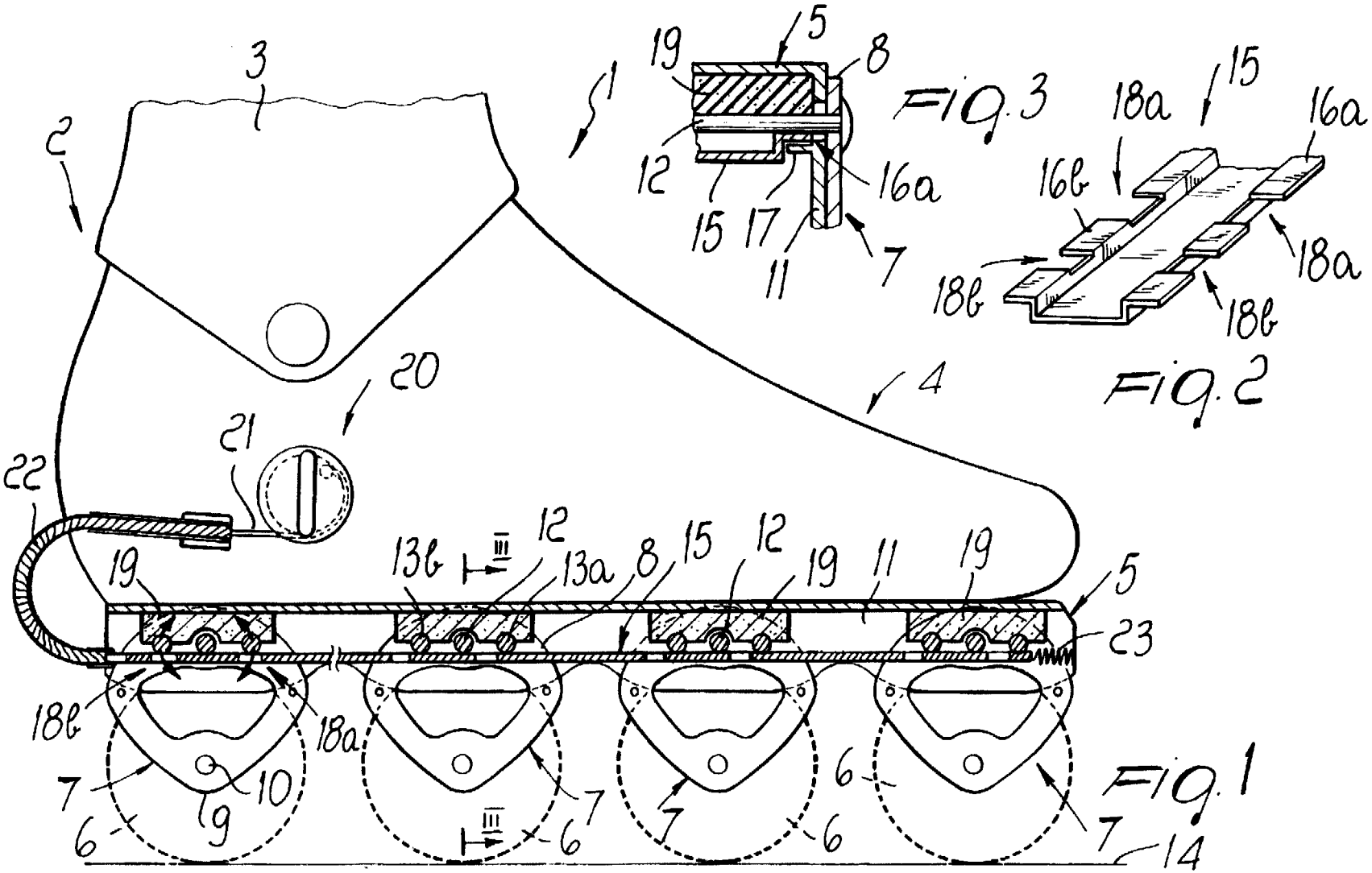
FIG. 1 is a partially sectional side view of the skate.
FIG. 2 is a lateral perspective view of a detail of the skate.
FIG. 3 is a sectional view, taken along the plane III—III of FIG. 1.

With reference to FIGS. 1–3, the reference numeral 1 designates the skate, which is constituted by a shoe 2 preferably composed of a quarter 3 that is articulated to a shell 4, a substantially U-shaped frame 5 being associated therebelow. The frame 5 has an essentially horizontal extension generally lying below the sole of the user's foot.

The skate comprises a means for damping only forces applied to the wheels, along axes that are not at right angles to the extension of the frame 5, as will beome clear hereinafter. Said means comprises an oscillating support designated by the reference numeral 7. The illustrated embodiment comprises four such supports 7, one each for a respective wheel.

Each oscillating support 7 has a substantially triangular shape, wherein the base 8 is curved so that its convex part is directed towards the overlying shell 4, whereas a wheel 6 is pivoted at the vertex 9 of the triangular-shaped support 7 by means of a first pivot 10.

Each oscillating support 7 is rotatably associated, at the base 8, transversely to the wings 11 of the frame 5 by means of an adapted second pivot 12.

Two third pivots **13*a* and 13*b* are transversely associated to the bases 8 of each oscillating support 7. The third pivots are equidistant from the second pivot 12 and are arranged on a plane that is approximately parallel to the extension of the frame 5, or alternatively to the extension of the ground 14 when all of the wheels are arranged in supporting contact with the ground 14 with the supports 7 in a non-pivoted configuration. FIG. 1 shows that circumferential surfaces of the plurality of wheels 6 lie essentially in a contact plane defined by the ground plane 14 when the plurality of oscillating supports 7 are configured in their non-pivoted positions. Moreover, the first pivot 10 and the second pivot 12 each lie in a respective plane which is essentially parallel to the contact plane of the wheels 6**, and a vertical plane extending perpendicularly to the contact plane of the wheels passes through both the first and second pivots.

A plate 15 is slidingly associated between the wings 11 of the frame 5 below the plane of arrangement of said second pivot 12 and of said third pivots **13*a* and 13*b* and can slide longitudinally with respect to the frame 5 in the interspace formed between said wings 11**.

Said plate 15 is laterally provided with two longitudinal flaps **16*a* and 16*b* that slide above adapted tabs 17 protruding inside the wings 11 of the frame 5**.

Two notches 18a and 18b are formed on each one of the longitudinal flaps 16a and 16b of the plate 15 at each one of the third pivots 13a and 13b of each oscillating support 7; their width is such as to allow, as shown in FIG. 1 in the wheel located at the rear end of the frame 5, the oscillating support 7 to oscillate, about the second pivot 12 since the third pivots will pass at the selected pair among the pairs of notches 18a and 18b so that they are free to oscillate.

A flexible element, such as for example a pad 19, has appropriate seats at said second and third pivots for its positioning. Pad 19 is interposed in the interspace formed between the plate 15 and the base of the frame 5 connecting the wings 11, at the region affected by said second pivot 12 and said third pivots 13a and 13b.

The plate 15 can be made to slide by means of an adapted knob 20 rotatably associated laterally with respect to the shell 4 or the quarter 3 and allowing to take up an end of a traction element, such as a cable 21 which is appropriately guided within an adapted sheath 22 and is connected, at its other end, for example to the end of the plate 15 protruding to the rear of the frame 5.

The longitudinal movement of the plate 15 is contrasted by an additional flexible element, such as a spring 23 interposed between the end of the plate lying opposite to the one that interacts with the cable 21 and said frame 5.

An activation of the knob 20, so as to reach a desired condition of stable equilibrium, forces the plate 15 to move so that the pairs of notches 18a and 18b are no longer located at the third pivots 13a and 13b of each oscillating support 7, as shown in FIG. 1 in the wheels that do not lie below the heel region.

In this manner, each oscillating support 7 is prevented from moving about the second pivot 12, so as to eliminate the damping condition described above.

Furthermore, if the configuration of the plate 15 is such that each support can oscillate about the second pivot 12, and therefore if the third pivots 13a and 13b are located at the notches 18a and 18b, the skater can still impart, for example during the pushing action, a force that is applied at right angles to the contact plane of the wheel 6 when the support 7 are in their non-pivoted positions: in this case, in fact, the force is transmitted through the second pivot 12, along a line extending between the first pivot 10 and the second pivot 12.

Vice versa, if the wheels encounter for example a depression or an obstacle along their path, the support rocks in contrast with the pad 19, thus providing a shock-absorbing action. From the foregoing description, in the illustrated embodiment of FIGS. 1–3, the axis connecting the first pivot 10 and the second pivot 12 lies in a vertical plane extending essentially perpendicularly to the contact plane of the wheels 6 when the supports 7 are in their non-pivoted positions. Forces acting on the wheel 6 for each support 7 which are directed along the axis connecting the first pivot 10 for the wheel 6 and the second pivot 12 for the support 7 are not damped but rather are directly transmitted since such forces will not cause the support 7 to oscillate about its pivot 12. On the other hand, forces acting on the wheel 6 for each support 7 which do not pass through the axis connecting the first pivot 10 and the second pivot 12, or which do not lie in the vertical plane of such axis, will cause the support to oscillate and will be damped by the action of the flexible pad 19. In the illustrated embodiment of FIGS. 1–3, it is seen that the oscillating support 7 pivoted to the frame 5 by means of the second pivot 12 and rotatably supporting the wheel 6 by means of the first pivot 10, together with the offset third pivots 13a and 13b connected to the support 7 and interacting with the flexible pad 19, form means for exclusively damping forces applied to the wheels acting in directions which do not lie in the vertical plane extending essentially perpendicularly to the contact plane of the wheels 6 when the supports 7 are in their non-pivoted configuration.

It has thus been observed that the invention has achieved the intended aim and objects, a skate having been provided that allows both to optimally transmit forces from the foot to the wheels during the pushing action and to damp any unevennesses of the ground, since they affect the wheels by generating forces the resultants whereof are not at right angles to the contact plane of the wheels.

The skate according to the invention is of course susceptible of numerous modifications and variations, all of which are within the scope of the same inventive concept.

Figure 4:
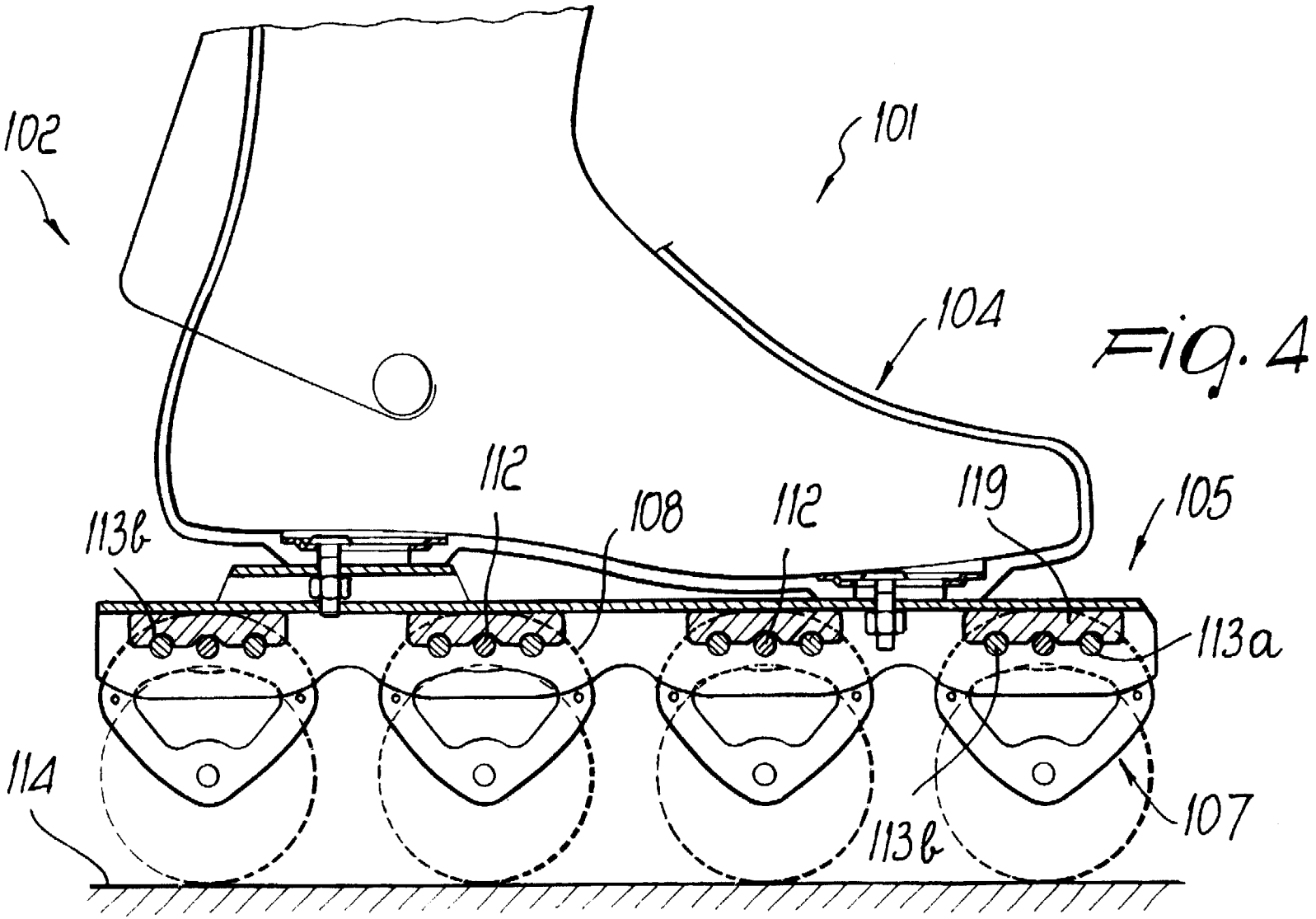
FIG. 4 is a view, similar to FIG. 1, of a second embodiment of the invention.

Thus, for example, FIG. 4 illustrates a skate 101 composed of a shoe 102 comprising a shell 104 that can be downwardly rigidly coupled at the base of a substantially U-shaped frame 105 between the wings whereof oscillating supports 107 are again transversely associated by means of second pivots 112.

Third pivots 113a and 113b are again transversely associated at the base 108 of each oscillating support 107 and are arranged at the same plane that passes through the second pivot 112 and is approximately parallel to the ground 114.

In this embodiment, there is no selection plate for the damped or non-damped condition of the skate, and a flexible element, such as a pad 119, is interposed between the second pivot 112 and the third pivots 113a and 113b with respect to the base of the frame 105.

Figure 5:
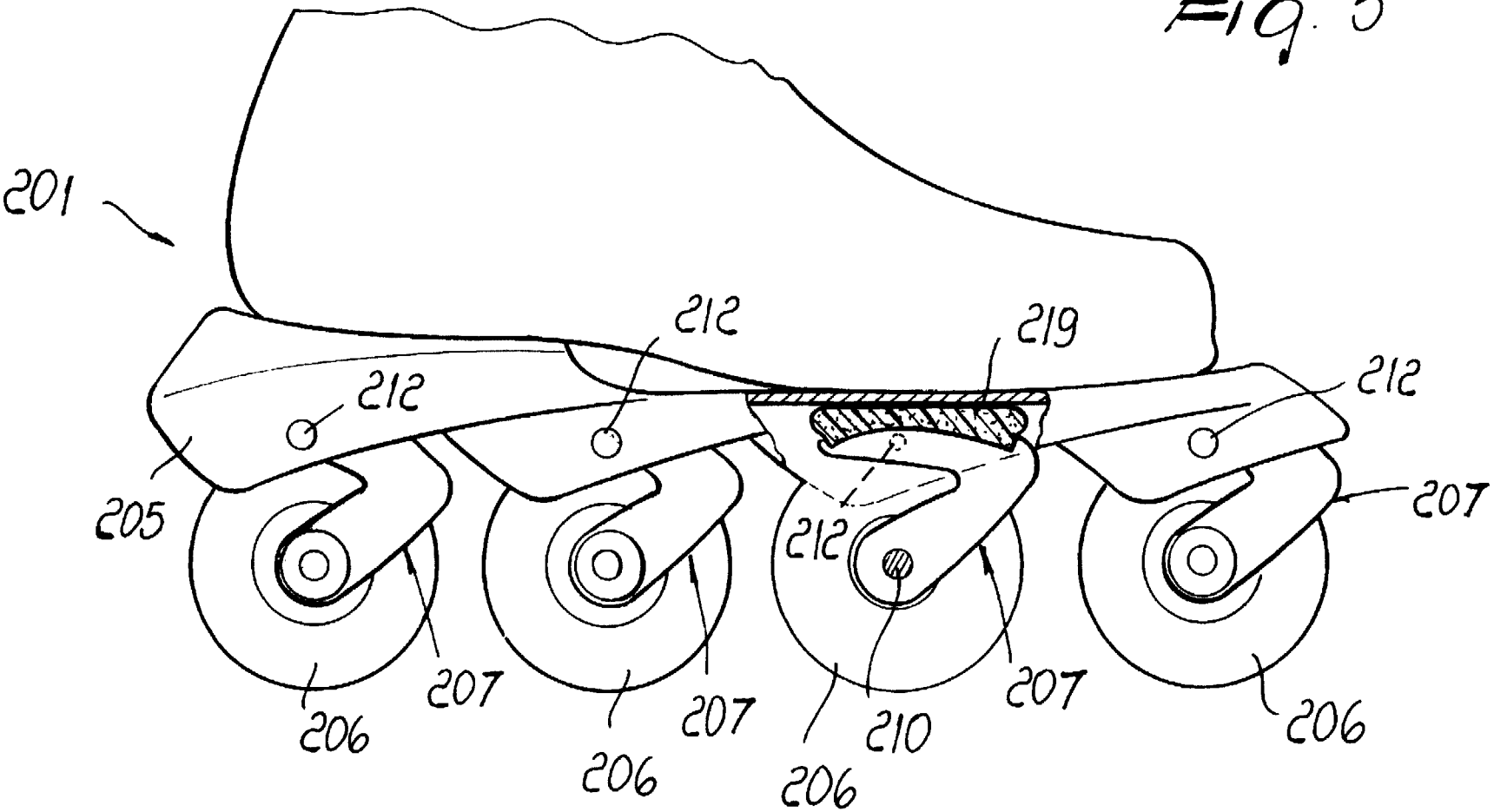
FIG. 5 is a side, partially sectioned, view of a third embodiment of the invention.

FIG. 5 illustrates a skate 201, according to a third embodiment of the invention.

Skate 201 comprises a plurality of oscillating supports 207 for respective wheels 206. Each support 207 is substantially V-shaped and is pivoted to the frame 205 by means of a second pivot 212 while a first pivot 210 connects the wheel 206 to the same support.

A damping means 219 is interposed between the support 207 and the frame 205 in order to provide a damping action when the support 207 oscillates about pivot 212.

Pivots 210 and 212 are on the same vertical axis, so that substantially vertical forces acting along such vertical axis are not damped while forces having a direction other than vertical or forces not acting along such vertical axis are damped, as explained above.

The components and the dimensions that constitute the individual components of the skate may of course be the most pertinent according to the specific requirements.

What is claimed is:

1. Roller skate with improved comfort comprising:

a frame having a horizontal extension;

a plurality of wheels; and a damping means connecting each of said wheels to said frame for exclusively damping forces applied to the wheels acting in a direction which extends essentially in a direction other than 90 degrees to the extension of the frame;

wherein said damping means comprise:

a plurality of oscillating supports;

a first pivot which rotatably connects a wheel of said plurality of wheels to a respective support of said plurality of supports about a first axis extending in a horizontal plane;

a second pivot which rotatably connects each said respective support of said plurality of supports to said frame exclusively about a single second axis extending in a horizontal plane such that each said respective support is capable of rotating only about said single second axis; and means for elastically biasing a rotation of each said respective support of said supports about said single second axis;

wherein said first axis and said single second axis for each said respective support lie in a single vertical plane which is perpendicular to said horizontal extension of said frame when said respective support is in a non-oscillated position whereby for each said respective support a force acting on said wheel extending in the single vertical plane fails to cause each said respective support to rotate about said single second axis.

2. Skate according to claim 1 further comprising a device for selectively activating and deactivating said damping means such that in a deactivated configuration of said damping means each said respective support is blocked from oscillating about any axis.

3. Skate according to claim 1 wherein each said respective support has a substantially triangular shape having a convex part of a curved base directed towards said frame and a vertex at which said first pivot is connected.

4. Skate according to claim 3 wherein said second pivot is connected at said curved base and between wings of said frame.

5. Skate according to claim 4 further comprising a pair of third pivots transversely connected to said base, said pair of third pivots being arranged equidistant from said second pivot on a horizontal plane.

6. Skate according to claim 5 further comprising a device for selectively activating and deactivating said damping means such that in a deactivated configuration of said damping means each said respective support is blocked from oscillating about any axis, said device comprising a plate that is slideable longitudinally with respect to said frame in an interspace formed in said frame, said plate being slidingly connected at said frame below the plane of arrangement of said second pivot and said pair of third pivots.

7. Skate according to claim 5 wherein said means for elastically biasing a rotation of each said respective support comprises for each said respective support a pad having seats for accommodating said second pivot and said pair of third pivots, said pad being interposed in the interspace formed between said frame and said second pivot and said pair of third pivots.

8. Skate according to claim 6, wherein said plate is provided with two longitudinal flaps that extend laterally from said plate and that slide over tabs protruding inside said frame.

9. Skate according to claim 8, wherein a pair of notches is formed on each one of said longitudinal flaps of said plate, at said pair of third pivots of each said respective support, said notches having a width which allows said pair of third pivots to pass therethrough in an activation configuration of said plate for an oscillation of each said respective support.

10. Skate according to claim 9 wherein in a deactivation configuration of said plate said pair of notches is located distally from said pair of third pivots for blocking a rotation of each said respective support.

11. Skate according to claim 6, wherein said plate is slidably moveable by means of a knob rotatably connected to said frame at a lateral position of said frame, said knob winding a traction element guided within a sheath and connected to a protruding end of said plate protruding at a rear of said frame.

12. Skate according to claim 11 further comprising a flexible element interposed between said frame and an end of said plate lying opposite to said protruding end.

13. Skate according to claim 1 wherein each said respective support is substantially V-shaped.

14. A roller skate with improved fit comprising:

a frame having an essentially horizontal extension;

a plurality of supports;

a plurality of wheels;

a first pivot for said each respective support pivotally connecting a respective wheel of said plurality of wheels to said each respective support about a respective first substantially horizontal pivot axis of said first pivot;

a second pivot for each respective support of said plurality of supports pivotally connecting said each respective support to said frame such that said each respective support is rotatable exclusively about a respective second substantially horizontal pivot axis of said second pivot;

damping elements connected to said each respective support for damping a rotation of said each respective support about said respective second pivot axis;

wherein for each said respective support said respective first pivot axis and said respective second pivot axis lie in a vertical plane which is substantially perpendicular to said horizontal extension of said frame when said respective support is in a non-rotated position whereby for each said respective support a force acting on said wheel in a direction extending in said vertical plane fails to cause each said respective support to rotate about said second axis.

15. The roller skate of claim 14 wherein said damping elements comprise, for each said respective support of said plurality of supports, a pair of third pivots connected to said respective support and arranged on a plane containing said respective second pivot axis such that said second pivot is arranged between said pair of third pivots, and a flexible pad connected below said frame and arranged for engaging said pair of pivots upon a rotation of said respective support.

16. The roller skate of claim 14 wherein each said respective support comprises a curved surface, and wherein said damping elements comprise flexible pads connected below said frame and each comprising a curved surface for mating with the curved surface of each said respective support.

17. A roller skate comprising:

a frame;

a plurality of oscillating supports rotatably connected with said frame;

a plurality of wheels rotatably connected with said plurality of oscillating supports and arranged such that circumferential surfaces of said plurality of wheels lie essentially in a contact plane when said plurality of oscillating supports are configured in non-pivoted positions;

a first pivot for each respective support of said plurality of oscillating supports rotatably connecting at least one wheel of said plurality of wheels to said each respective support such that said at least one wheel is rotatable about a respective first axis of said first pivot, said respective first axis lying in a plane which is essentially parallel to said contact plane;

a second pivot for said each respective support rotatably connecting said each respective support to said frame such that said each respective support is rotatable exclusively about a respective single second axis of said second pivot, said respective single second axis for said each respective support lying in a plane which is essentially parallel to said contact plane;

damping elements connected to said each respective support for damping a rotation of said each respective support about said respective single second axis;

wherein for said each respective support said respective first axis and said respective single second axis both lie in a vertical plane which is essentially perpendicular to said contact plane when said plurality of oscillating supports are configured in non-pivoted positions whereby for said each respective support a force acting on said at least one wheel in a direction lying in said vertical plane fails to cause said each respective support to rotate about said respective single second axis.

18. The roller skate of claim 17 further comprising means for selectively blocking a rotation of said each respective support about said respective single second axis.

19. The roller skate of claim 17 wherein for said each respective support said at least one wheel comprises a single wheel and wherein said plurality of wheels are arranged in a single line.

20. The roller skate of claim 17 wherein said damping elements comprise for said each respective support a pair of third pivots connected to said each respective support and mutually extending at opposite sides with respect to said vertical plane.

21. The roller skate of claim 17 wherein said damping elements comprise for said each respective support a curved surface of said each respective support and a flexible pad connected below said frame and having a curved surface for mating with the curved surface of said each respective support.

22. The roller skate of claim 17 wherein said second pivot blocks said each respective support from moving in a direction lying in said vertical plane.

* * * * *